United States Patent [19]

Willingham

[11] 4,060,163

[45] Nov. 29, 1977

[54] KEYBOARD GUARD

[76] Inventor: James S. Willingham, No. 1 Shari Drive, Des Peres, Mo. 63122

[21] Appl. No.: 657,620

[22] Filed: Feb. 12, 1976

[51] Int. Cl.[2] ..... B41J 29/04

[52] U.S. Cl. ..... 197/105; 178/17 C; 235/145 R

[58] Field of Search ..... 197/98, 100, 102, 105, 197/107; 178/17 C; 235/145 R; 200/294, 304

[56] References Cited

U.S. PATENT DOCUMENTS

| | | | |
|---|---|---|---|
| 3,158,317 | 11/1964 | Alexander | 235/145 R |
| 3,290,439 | 12/1966 | Willcox et al. | 197/98 |
| 3,507,378 | 4/1970 | Stuckert | 197/98 |
| 3,517,637 | 6/1970 | Kaiser | 235/145 R X |
| 3,567,001 | 3/1971 | Johnson et al. | 197/98 X |
| 3,627,927 | 12/1971 | Schimtz et al. | 197/98 X |
| 3,777,222 | 12/1973 | Harris | 235/145 R |
| 3,871,506 | 3/1975 | Luders | 197/98 |
| 3,879,602 | 4/1975 | Walker | 197/98 X |
| 3,890,480 | 6/1975 | Berling et al. | 235/145 R X |
| 3,962,556 | 6/1976 | Kravchuck | 197/98 X |

OTHER PUBLICATIONS

"Keyboard Overlay" Cross, IBM Techn. Discl. Bull. vol. 15, No. 1, June 1972, p. 31.

*Primary Examiner*—E. H. Eickholt
*Attorney, Agent, or Firm*—Paul M. Denk

[57] ABSTRACT

A guard for protecting the keys of a keyboard from being untimely depressed, the guard is formed of a rigid material, such as an acrylic plastic, and contains an aperture(s) therethrough for accommodating the positioning of the keys therein, so as to avoid their being depressed other than when acted upon intentionally by a machine operator. The apertures may be in the form of a pair of slots extending the length of the guard and which are designed for accommodating at least a pair of rows of keys therein, with the guard containing a vinyl decal that is imprinted with indicia to indicate the function of the proximate keys upon depressing. The guard contains either one or more holes provided there through and into each a pin projecting from the keyboard may be inserted for providing proper positioning of the guard, or alternatively, stick angles may be provided at the corners of the guard to insure its reasonably stationary positioning upon the keyboard.

13 Claims, 6 Drawing Figures

KEYBOARD GUARD

BACKGROUND OF THE INVENTION

This invention relates generally to a guard, but more particularly, pertains to a keyboard guard that prevents an untimely actuation of the keys of a machine keyboard so as to prevent an improper functioning of the said machine.

Usually keyboard guards for various types of machinery, such as the typewriter, the small hand computers now in vogue, are even larger computers, generally are of the type that are permanently built into the surrounding keyboard structure, and usually includes just an inherent ridge that extends upwardly around the periphery of the composite of the keys forming the keyboard, so as to somewhat prevent one from contacting one or more of the keys from the side. In other such instruments, the keyboard itself is formed of the touch tone type, usually including keys that operate either upon leaf contacts, or the like, with the keys being almost totally embedded within the keyboard, with their upper surface being somewhat flush with the surrounding integral structure of the board. Such protective measures for a keyboard are not only desirable, but have worked effectively for their intended purpose. On the other hand, where keyboards for various types of instruments, such as computers, are formed with their keys projecting above the keyboard surface, frequently no such guards are provided laterally of the keys, and it is an easy mishap for one, without thinking, to lean against one or more keys and thereby initiate an unwanted machine function.

One such example of the aforesaid type of predicament can easily occur with respect to some of the current computers that are operated from a keyboard and which then completes the function of other instrumentations, such as various telephone relay circuitry. For example, the E.S.S. computer which is generally used to control the myriad of circuits forming a branch office relay control station for the various telephone companies, displays a series of rows of keys that project approximately a quarter inch or more above the surface of the keyboard used for controlling the master computer operations. Since this keyboard is disposed in a position where it can be easily actuated by anyone leaning against the board, it is desirable to provide some form of a guard that may be affixed surrounding the keys so as to prevent their untimely depression. If any one key on the board should be accidentally pushed, such could cause severe damage to the functioning of the relay station operations, and disconnect telephone service for a widespread area until the mistake is detected, and then corrected. Hence, the preferred embodiment of the invention explained herein is particularly designed as a portable type of guard for use in preventing accidental manipulation of keys of such a computer keyboard from occurring.

It is, therefore, the principal object of this invention to provide a guard for a keyboard that helps to prevent any depressing of a key when not intended.

A further object of this invention is to provide a guard for a keyboard which is removable, and even reversible, in its positioning.

A further object of this invention is to provide a guard for a keyboard which includes a decal on one or both of its surfaces, and which decal may be imprinted with indicia for indicating the function of the various proximate keys provided upon the keyboard.

A further object of this invention is to provide a guard for a keyboard that is easy to manufacture, inexpensive in cost, but yet very functional in its use in conjunction with various keyboards, particularly those associated with computers.

Other objects will become more apparent to those skilled in the art upon reviewing the summary of this invention, and upon considering the description of the preferred embodiment herein in view of its drawings.

SUMMARY OF THE INVENTION

This invention contempates a guard for protecting the keyboard of various machinery. The guard is formed from any rigid material, such as a hardened plastic, and which includes a series of apertures provided therethrough, preferably in the form of slots, and which conform in a dimension only slightly larger than the arrangement of the various keys so as to maintain contiguity but preferably not touching the keys of the board. Furthermore, the guard is designed having a thickness or heighth equal to or slightly in excess of the heighth of the keys in their projection above the keyboard, so that the keys may not even be even slightly depressed when untimely contacted. In the preferred embodiment, the guard is approximately 25 inches in length, five and one-half inches in width, and a half inch in thickness. Obviously these dimensions will vary with the keyboard being protected.

The guard is provided with a decal to either one or both of its surfaces, and which decal may be imprinted with the various indicia such as numbering, letters, or even explanatory information that renders more facile the manipulation of the keys, and also making their depressing much more precise and accurate. The decal may be formed from a vinyl film, therefore being washable, and preferably having an adhesive surface that is pressure sensitive for adherence to the acrylic plastic guard, so as to provide a guard that is reasonably sturdy and rigid in construction, and having a prolonged useful life.

It should also be commented that the guard of this invention might be permanently affixed to the keyboard of any machine, or, it might even be integrally constructed into the keyboard. For example, where the structure forming and surrounding the keyboard may be constructed of metal or other moldable material, the metal structure may be originally formed having the keyboard guard if this invention shaped therein. Then the decals could just be applied directly to this molded structure.

DESCRIPTION OF THE PREFERRED EMBODIMENT

Figure 1:
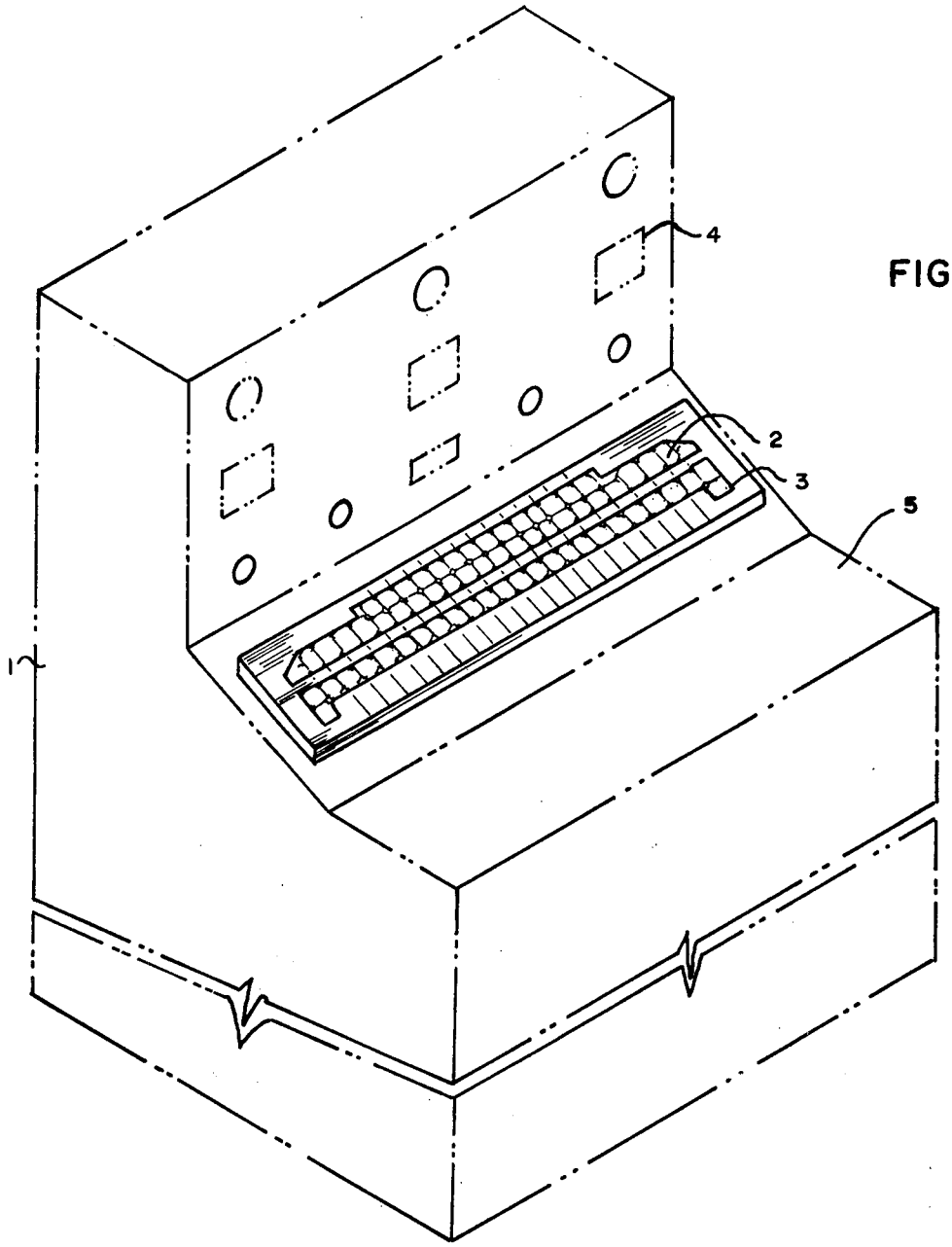
FIG. 1 displays the outline of a computer, shown in perspective, with the guard of this invention being arranged surrounding its keyboard.
Figure 3:
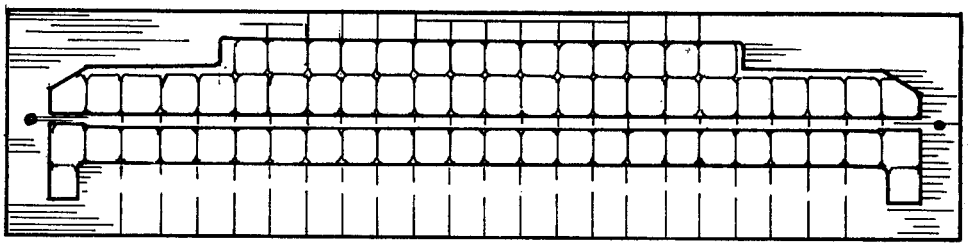
FIG. 3 provides a plan view of the guard of this invention, as applied upon a keyboard.

In referring to the drawings, and in particular FIG. 1, there is disclosed in phantom line a computer 1 of the type which normally includes a keyboard 2 embodying a variety of arranged keys thereon, and applied to the keyboard is the guard 3 of this invention, and of the type designed to prevent the unauthorized actuation of the keys. Such a computer normally also includes a display panel 4 and a level shelf 5, as shown. As previously described, this type of computer may be incorporated within a relay station of a telephone company office, and control the operation of literally thousands of telephone lines to the surrounding area. Actually, though, the principle of the guard of this invention may be utilized in conjunction with any style of keyboard provided upon the various like machinery, and therein be used to prevent the depressing of its keys other than when such is fully contemplated by the operator.

Figure 2:
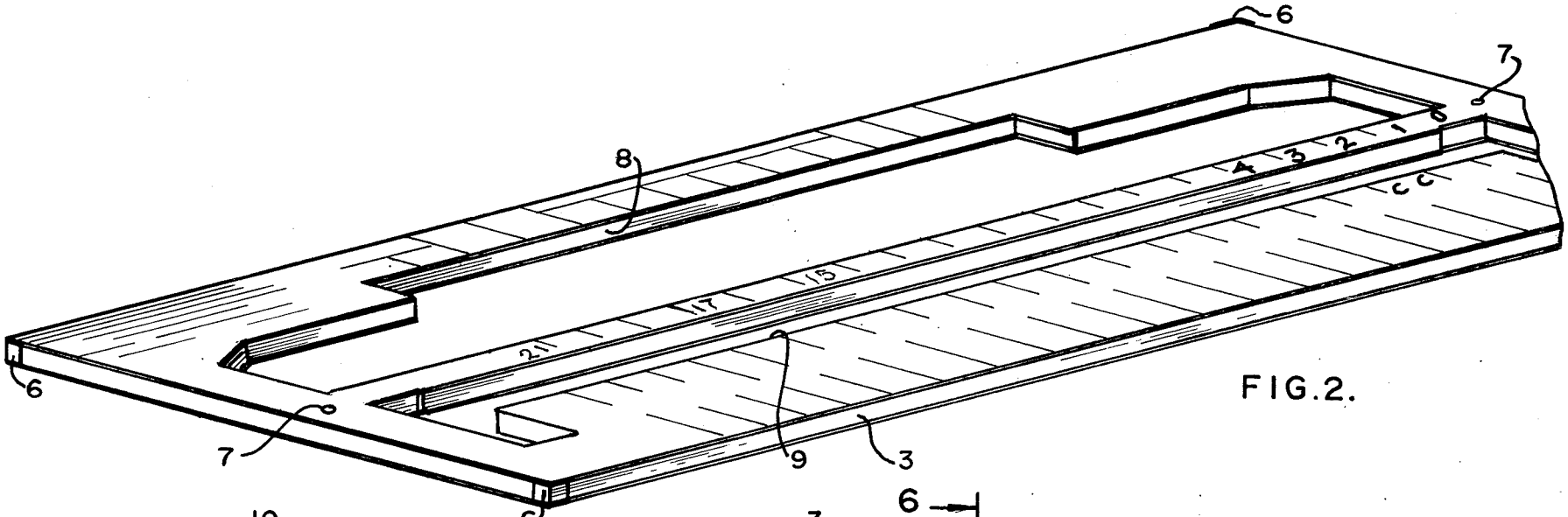
FIG. 2 provides a perspective view of the keyboard guard of this invention.
Figure 4:
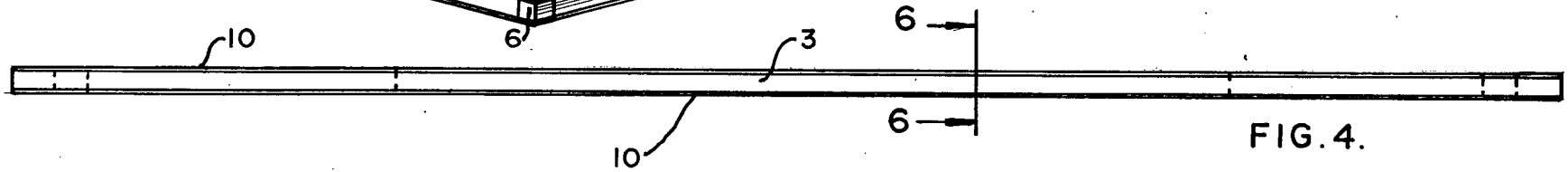
FIG. 4 provides a front edge view of the guard of this invention.
Figure 6:
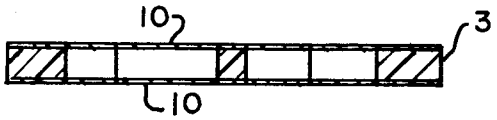
FIG. 6 provides a sectional view taken through the guard along line 6—6 of FIG. 4.
Figure 5:
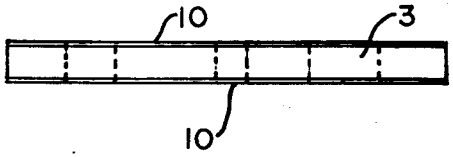
FIG. 5 provides a side edge view of the guard of this invention.

The actual guard 3 is shown in perspective view in FIG. 2, and is disclosed as being of rectangular design, being of a dimension to accommodate its fit upon the keyboard of the office machine 1. To maintain the positioning of the guard upon the keyboard, and not to rely soley upon the projecting keys from the keyboard to insure proper positioning of the guard, the guard may be provided with a series of stick angles 6 at the corners, as shown, which angles are constructed of any type of paper or plastic, reasonably flexible, and which have tacky upper and lower edges that frictionally adhere to the surface upon which the guard rests. In the alternative, the guard may be provided with a pair of holes as at 7, proximate each side, and cooperate with pins (not shown) that may be permanently affixed to and project upwardly from the keyboard, thereby positioning the guard at a particular location upon the keyboard, and preferably one that will prevent its rubbing against the keys, nor impede the pressing of any particular key.

The guard is preferably constructed of a plastic material, and in the preferred embodiment, an acrylic plastic has been used in its formation. In fact, the commercial model of this invention includes a laminated pair of sheets of the precisely cut guard, since it has been found easier to cut the commercial guard to the desired thickness in this manner. The pair of sheets are then adhesively connected together. On the other hand, it is likely that the guard could be constructed of wood or any other material, but it is unlikely that such other materials could work as effectively as the reasonably lightweight but yet sturdy plastic.

The guard is provided with a series of apertures therethrough, as at 8 and 9, and these apertures are provided having somewhat elongated length, designed from side to side of the guard, and generally are positioned within the guard in a manner that conforms with the arrangement of the keys upon the keyboard. In the particular computer shown, there are three rows of keys arranged from side to side of the keyboard, as can be seen in FIG. 1, so therefore, the slots will be arranged somewhat parallel in length, provided laterally of the guard, and fit contiguously, without touching, the keys when fitted upon the keyboard.

Usually, in such a construction, the keys may project within the vicinity of one quarter to one half inch above the keyboard of the computer, actually three-eighth inch in the herein identified computer, and the guard of this invention is designed having a thickness of around ½ inch, or slightly more or less, so as to at least be the same heighth, or having a heighth slightly greater, than the projection of the keys above the board. Preferably, the guard will have a heighth that is equal to or slightly in excess of the projection of any keys above the keyboard to which the guard is designed to provide protection.

In the fabrication of this guard, as previously commented, the main body of the guard 3 is constructed of an acrylic plastic, but the guard is further provided with a series of indicia upon one or both of its surfaces, and this has been achieved by the application of a vinyl decal 10 to one or both surfaces of the guard and therein provide informative data respecting the particular keys of the keyboard. Such a decal may also be constructed of any form of resistant paper or other materials that can withstand for some period of time contact with the human hand. Thus, since a vinyl decal can be washed and cleaned, it is preferred. In the commercial embodiment, one such vinyl decal containing a variety of indicia that provides explanatory information respecting each key of the keyboard, will be applied to either side of the guard. Then, where the keyboard is of the shift type, where one particular key may be depressed so that it will provide for an alternative operation of the remaining keys of the keyboard, then the guard may be reversible in its positioning upon the keyboard so as to provide alternate data relative to the keys depending upon the particular function set within the computer for the displayed keys. The indicia may be applied to the vinyl decal by any form of printing method, such as by the silk screen printing process.

Variations in the construction of the guard of this invention may occur to those skilled in the art upon reviewing this disclosure. Any such variations, within the spirit and scope of this invention, and encompassed by the claims appended hereto, are intended to be protected by any patent issuing hereon. The description of the preferred embodiment herein is intended for illustration purposes only.

Having thus described the invention what is claimed and desired to be secured by Letters Patent is:

1. A guard for protecting the keys of a keyboard from being untimely depressed, comprising a guard formed of a rigid material having a thickness equal to or exceeding the heighth of the keys above the keyboard, said guard having at least one aperture provided therethrough allowing for projection of the keys therein when the guard is emplaced, said guard providing for totally surrounding the sides of the composite keys arranged therein to prevent their lateral contact, said guard being reversible upon the keyboard, and said guard aperture generally conforming to the arrangement of the keys upon the keyboard to provide for a proximity of the guard with respect to the surrounded keys.

2. The invention of claim 1 wherein said aperture comprises at least one elongated slot provided lengthwise through the guard and for use in accommodating a row of keys.

3. The invention of claim 2 wherein said aperture comprises a pair of parallel slots provided lengthwise of the guard and for use in accommodating at least a pair of rows of keys.

4. The invention of claim 1 wherein said guard is constructed of plastic.

5. The invention of claim 4 wherein said guard is constructed of an acrylic.

6. The invention of claim 5 wherein said guard contains indicia imprinted thereon for indicating the function initiated upon depressing of a proximate key.

7. The invention of claim 6 and further including a decal applied to at least one surface of the guard, and said indicia being imprinted upon said decal.

8. The invention of claim 4 and including said guard having a hole provided proximate each of its sides, said holes designed for cooperating with means upon the keyboard for positioning of the guard with respect to the surrounded keys.

9. The invention of claim 1 wherein the guard when emplaced maintaining a position of contiguity without touching the sides of the surrounded keys.

10. A guard for protecting the keys of a keyboard from being untimely depressed, comprising a guard formed of a rigid material and having a thickness equal to or exceeding the heighth of the keys above the keyboard, said guard having at least one aperture provided therethrough allowing for projection of the keys therein when the guard is emplaced, said guard providing for totally surrounding the sides of the composite keys arranged therein to prevent their lateral contact, said guard aperture generally conforming to the arrangement of the keys upon the keyboard to provide for a proximity of the guard with respect to the surrounded keys, and said guard containing indicia imprinted thereon for indicating the function initiated upon depressing a proximate key.

11. A guard for protecting the keys of a keyboard from being untimely depressed, comprising a guard formed of a rigid plastic material and having a thickness equal to or exceeding the heighth of the keys above the keyboard, said guard having at least one aperture provided therethrough allowing for projection of the keys therein when the guard is emplaced, said guard providing for totally surrounding the sides of the composite keys arranged therein to prevent their lateral contact, said guard aperture generally conforming to the arrangement of the keys upon the keyboard to provide for a proximity of the guard with respect to the surrounded keys, and there being a pair of indicia imprinted decals applied to the guard, with one of said decals being affixed to either surface of the same.

12. The invention of claim 11 wherein each decal includes a pressure sensitive adhesive on one side to facilitate its adherence to a surface of the guard.

13. A guard for protecting the keys of a keyboard from being untimely depressed, comprising a guard formed of a rigid material and having a thickness equal to or exceeding the heighth of the keys above the keyboard, said guard having at least one aperture provided therethrough allowing for projection of the keys therein when the guard is emplaced, positioning means provided proximate each corner of the guard, said positioning means having tacky upper and lower edges to provide for the positioning and temporary adherence of the guard upon the keyboard, said guard providing for totally surrounding the sides of the composite keys arranged therein to prevent their lateral contact, and said guard aperture generally conforming to the arrangement of the keys upon the keyboard to provide for a proximity of the guard with respect to the surrounded keys.

* * * * *